US010586506B2

(12) United States Patent
Im et al.

(10) Patent No.: US 10,586,506 B2
(45) Date of Patent: Mar. 10, 2020

(54) DISPLAY DEVICE WITH LOW POWER CONSUMPTION

(71) Applicant: SAMSUNG DISPLAY CO., LTD., Yongin-si, Gyeonggi-Do (KR)

(72) Inventors: Taegon Im, Gwangmyeong-si (KR); Wontae Kim, Hwaseong-si (KR); Guhui Jo, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 99 days.

(21) Appl. No.: 15/446,763

(22) Filed: Mar. 1, 2017

(65) Prior Publication Data

US 2017/0278475 A1 Sep. 28, 2017

(30) Foreign Application Priority Data

Mar. 28, 2016 (KR) ..... 10-2016-0037082

(51) Int. Cl.
*G09G 3/36* (2006.01)

(52) U.S. Cl.
CPC ..... *G09G 3/3688* (2013.01); *G09G 3/3677* (2013.01); *G09G 3/3696* (2013.01); *G09G 2310/0291* (2013.01); *G09G 2330/021* (2013.01)

(58) Field of Classification Search
None
See application file for complete search history.

(56) References Cited

U.S. PATENT DOCUMENTS 7,969,403 B2 * 6/2011 Sheu ..... G09G 3/3688 345/100
2007/0024570 A1 * 2/2007 Kumamoto ..... H05B 41/282 345/102
2014/0247295 A1 * 9/2014 Hussain ..... G09G 3/3611 345/691
2015/0130850 A1 * 5/2015 Wyatt ..... G09G 3/342 345/690

FOREIGN PATENT DOCUMENTS

KR 1020120068425 6/2012
KR 10-1520868 5/2015

* cited by examiner

*Primary Examiner* — Christopher J Kohlman
(74) *Attorney, Agent, or Firm* — F. Chau & Associates, LLC

(57) ABSTRACT

A display device includes a display panel, a timing controller, a data driver, and a light source unit. The display panel includes a plurality of data lines. The timing controller receives a control signal and image data, and outputs a data control signal, converted image data, and a mode selection signal. The data driver receives the data control signal, the converted image data, and the mode selection signal from the timing controller, outputs a data voltage to the plurality of data lines, and operates in a first mode which is a power saving mode or a second mode which is a normal driving mode in response to the mode selection signal. The light source unit includes a light source part that operates in association with a source driving circuit included in the data driver.

19 Claims, 7 Drawing Sheets

DISPLAY DEVICE WITH LOW POWER CONSUMPTION

CROSS-REFERENCE TO RELATED APPLICATION

This U.S. non-provisional patent application claims priority under 35 U.S.C. § 119 to Korean Patent Application No. 10-2016-0037082, filed on Mar. 28, 2016 in the Korean Intellectual Property Office, the disclosure of which is incorporated by reference herein in its entirety.

TECHNICAL FIELD

Exemplary embodiments of the inventive concept relate to a display device, and more particularly, to a display device with low power consumption.

DISCUSSION OF RELATED ART

In general, a liquid crystal display device includes a liquid crystal display panel for displaying images by using light transmittance of liquid crystals and a backlight unit disposed under the liquid crystal display panel to provide light to the liquid crystal display panel. A dimming technology may be applied to the liquid crystal display device to reduce the amount of light of the backlight unit while increasing the amount of light transmitted to pixels of the liquid crystal display panel. The backlight unit may be divided into a plurality of blocks, and the blocks emit light with different luminances.

SUMMARY

According to an exemplary embodiment of the inventive concept, a display panel includes a plurality of data lines, a timing controller, a data driver, and a light source unit. The timing controller is configured to receive a control signal and image data, and output a data control signal, converted image data, and a mode selection signal. The data driver is configured to receive the data control signal, the converted image data, and the mode selection signal from the timing controller, output a data voltage to the plurality of data lines, and operate in a first mode which is a power saving mode or a second mode which is a normal driving mode in response to the mode selection signal. The light source unit is configured to operate in association with the data driver. The data driver includes a first source driving circuit including a first buffer group and a second buffer group. The first source driving circuit is configured to output the data voltage via the first buffer group when operating in the first mode and to output the data voltage via the second buffer group when operating in the second mode. The light source unit includes a first light source part configured to operate in association with the first source driving circuit. The first light source part is turned off when the first source driving circuit operates in the first mode and is turned on when the first source driving circuit operates in the second mode.

In an exemplary embodiment of the inventive concept, the first light source part may provide light to a region of the display panel that receives the data voltage from the first source driving circuit.

In an exemplary embodiment of the inventive concept, the first light source part may be turned on or turned off in response to the mode selection signal.

In an exemplary embodiment of the inventive concept, the data driver may further include a second source driving circuit disposed adjacent to the first source driving circuit, and the light source unit may further include a second light source part configured to operate in association with the second source driving circuit.

In an exemplary embodiment of the inventive concept, a luminance of light provided from the second light source part when both the first light source part and the second light source part are turned on may be lower than the luminance of the light provided from the second light source part when the first light source part is turned off and the second light source part is turned on.

In an exemplary embodiment of the inventive concept, the light source unit may further include a third light source part disposed between the first light source part and the second light source part. The third light source part may be configured to operate in association with the first source driving circuit and the second source driving circuit. The third light source part may be turned off when both the first source driving circuit and the second source driving circuit operate in the first mode, and may be turned on when at least one of the first source driving circuit or the second source driving circuit operates in the second mode.

In an exemplary embodiment of the inventive concept, each of the plurality of data lines may extend along a first direction, and the second light source part may be spaced apart from the first light source part in a second direction intersecting with the first direction.

In an exemplary embodiment of the inventive concept, each of the first light source part and the second light source part may include a plurality of light sources, and the plurality of light sources is arranged along the first direction.

In an exemplary embodiment of the inventive concept, the display device may further include a light guide part disposed under the display panel. The first light source part and the second light source part may be arranged to face one side of the light guide part.

In an exemplary embodiment of the inventive concept, the number of buffers included in the first buffer group may be smaller than the number of buffers included in the second buffer group.

According to an exemplary embodiment of the inventive concept, a display device includes a display panel configured to display an image and including a plurality of data lines, a data driver configured to supply a data voltage to the plurality of data lines and including a plurality of source driving circuits, and a light source unit configured to provide light to the display panel and including a plurality of light source parts configured to operate in synchronization with the plurality of source driving circuits. Each of the plurality of source driving circuits includes a first buffer group and a second buffer group. When a first portion of the plurality of source driving circuits operates in a first mode and a second portion of the plurality of source driving circuits operates in a second mode, the first portion of the plurality of source driving circuits outputs the data voltage via the first buffer group to display a black image, a first portion of the plurality of light source parts is turned off, the second portion of the plurality of source driving circuits outputs the data voltage via the second buffer group, and a second portion of the plurality of light source parts is turned on.

The plurality of source driving circuits and the plurality of light source parts may correspond to one another on a one-to-one basis for synchronization, and when a first source driving circuit amongst the plurality of source driving circuits operates in the first mode, a first light source part amongst the plurality of light source parts, which is synchronized with the first source driving circuit, may be turned off.

In an exemplary embodiment of the inventive concept, a luminance of a second light source part amongst the plurality of light source parts, which is adjacent to the first light source part, may be higher when the first light source part is turned off than when the first light source part is turned on.

In an exemplary embodiment of the inventive concept, a luminance of turned-on light source parts may be higher when at least one but not all of the plurality of light source parts are turned on than when all the plurality of light source parts are turned on.

In an exemplary embodiment of the inventive concept, each of the plurality of light source parts may be synchronized with two or more corresponding source driving circuits amongst the plurality of source driving circuits, and for each of the plurality of light source parts, that light source part may be turned off when all of the corresponding source driving circuits synchronized therewith operate in the first mode.

In an exemplary embodiment of the inventive concept, wherein each of the plurality of data lines may extend along a first direction, and the plurality of light source parts may be arranged along a second direction intersecting with the first direction.

In an exemplary embodiment of the inventive concept, each of the plurality of light source parts may include a plurality of light sources, and the plurality of light sources may be arranged along the first direction.

In an exemplary embodiment of the inventive concept, the display device may further include a light guide part disposed under the display panel, and the plurality of light source parts may be arranged to face one side of the light guide part.

In an exemplary embodiment of the inventive concept, the number of buffers included in the first buffer group may be smaller than the number of buffers included in the second buffer group.

According to an exemplary embodiment of the inventive concept, a display device includes a display panel including a plurality of data lines, a data driver including a source driving circuit, and a light source unit including a light source part configured to operate in synchronization with the source driving circuit. The source driving circuit includes a first buffer group and a second buffer group. The first buffer group is connected to the plurality of data lines via a first switch and includes a first buffer and a second buffer. The second buffer group is connected to the plurality of data lines via a second switch. In a first mode of the source driving circuit, the light source part is turned off, the first switch is turned on, the second switch is turned off, and each of the plurality of data lines is electrically connected to either the first buffer or the second buffer. In a second mode of the source driving circuit, the light source part is turned on, the first switch is turned off, and the second switch is turned on.

BRIEF DESCRIPTION OF THE DRAWINGS

The above and other features of the present inventive concept will become more apparent by describing in detail exemplary embodiments thereof with reference to the accompanying drawings.

DETAILED DESCRIPTION

Figure 1:
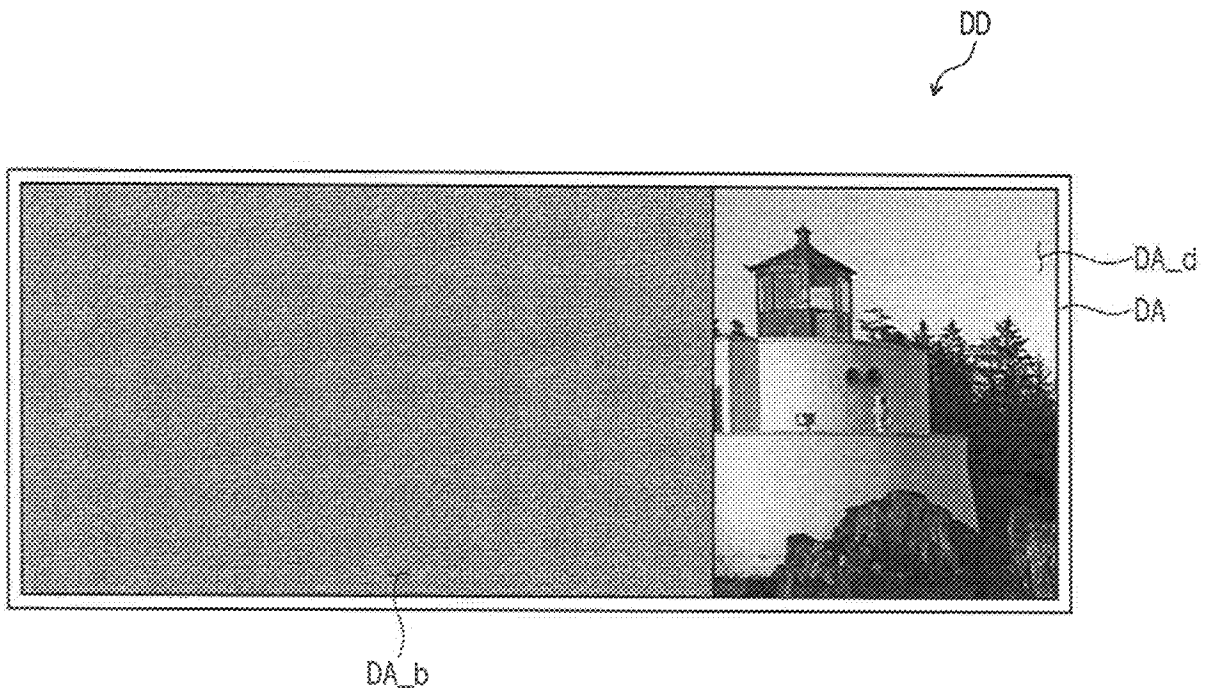
FIG. 1 is a planar diagram illustrating a display device according to an exemplary embodiment of the inventive concept.

Exemplary embodiments of the inventive concept will be described more fully hereinafter with reference to the accompanying drawings. Like reference numerals may refer to like elements throughout this application.

Exemplary embodiments of the inventive concept provide a display device with low power consumption.

Figure 2:
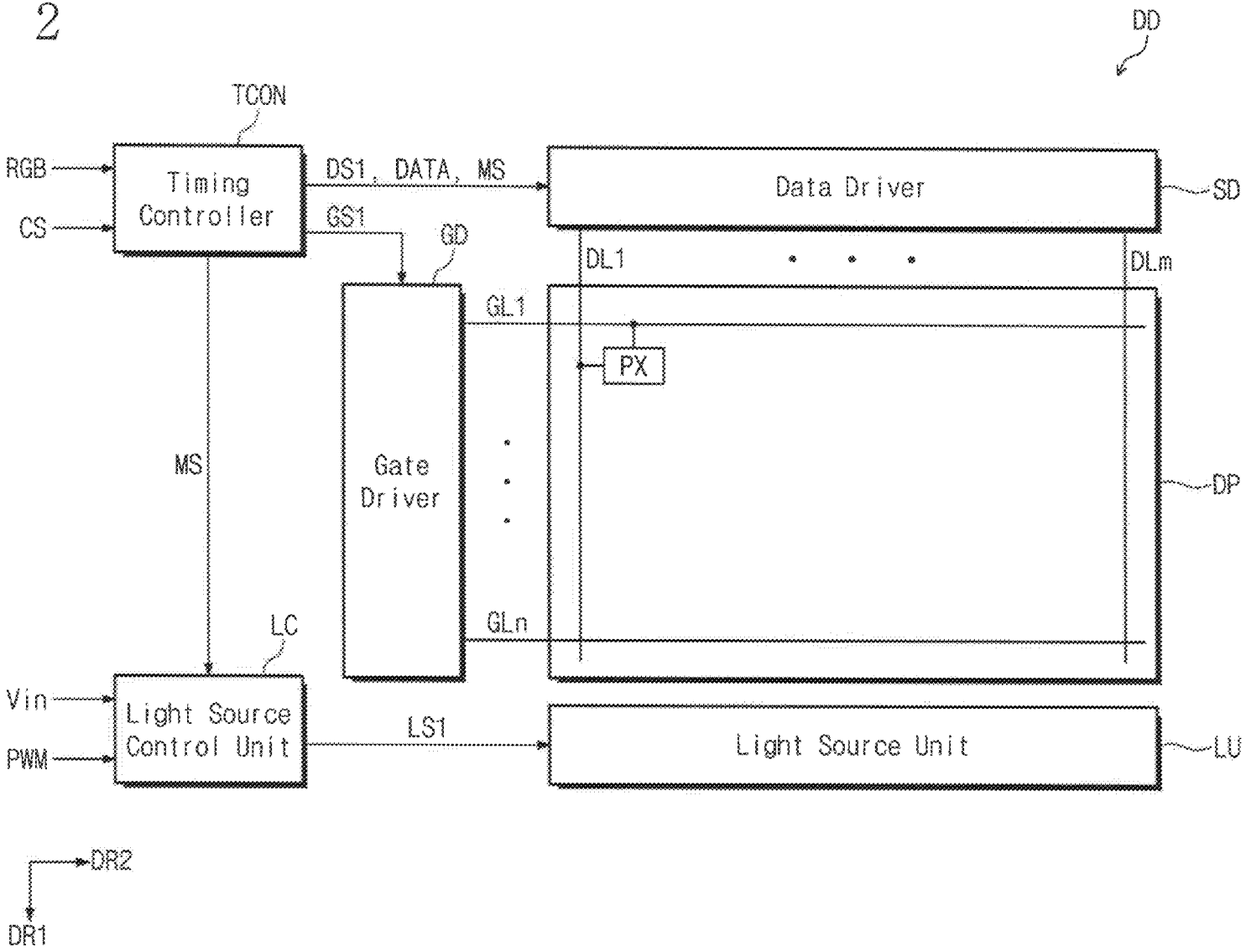
FIG. 2 is a block diagram illustrating a display device according to an exemplary embodiment of the inventive concept.

FIG. 1 is a planar diagram illustrating a display device according to an exemplary embodiment of the inventive concept, and FIG. 2 is a block diagram illustrating a display device according to an exemplary embodiment of the inventive concept.

FIGS. 1 and 2 illustrate a television as an example of a display device DD. However, the inventive concept is not limited thereto. For example, the display device DD may be a medium- or large-size display device such as a laptop computer, an all-in-one computer, an advertising board, or the like, or a small- or medium-size display device such as a center information display (CID) for use in a vehicle, a wristwatch-type electronic device, a personal digital assistant (PDA), a portable multimedia player (PMP), a game console, a tablet personal computer (PC), a smartphone, a vehicle navigation unit, a camera, or the like. These devices are merely examples, and thus, the display device DD may be applied to other electronic devices as well.

The display device DD may include a display panel DP, a timing controller TCON, a gate driver GD, a data driver SD, a light source control unit LC, and a light source unit LU.

The display panel DP may display, through a display region DA, an image corresponding to input image data. The display panel DP according to the present exemplary embodiment may include various types of display panels, such as a liquid crystal display panel, a plasma display panel, an electrophoretic display panel, or an electrowetting display panel.

The display panel DP may include a plurality of data lines DL1 to DLm, a plurality of gate lines GL1 to GLn, and a pixel PX.

Each of the data lines DL1 to DLm may extend in a first direction DR1, and each of the gate lines GL1 to GLn may extend in a second direction DR2 intersecting (e.g., substantially perpendicular) with the first direction DR1. The data lines DL1 to DLm and the gate lines GL1 to GLn may define pixel regions, each of which may be provided with the pixel PX for displaying an image.

FIG. 2 exemplarily illustrates the pixel PX connected to a first data line DL1 and a first gate line GL1. The pixel PX may display a primary color or a mixed color. Primary colors may include red, green, blue, or white, and mixed colors may include yellow, cyan, magenta, etc. However, the inventive concept is not limited thereto.

The timing controller TCON may receive a control signal CS and image data RGB from the outside of the display device DD (e.g., from a host).

The control signal CS may include a vertical synchronization signal for differentiating frames, a horizontal synchronization signal for differentiating rows, a data enable signal for indicating a data-incoming section, and a main clock signal.

The timing controller TCON converts the image data RGB so that the image data RGB is compatible with a specification of the data driver SD, and outputs converted image data DATA to the data driver SD. The timing controller TCON also generates a gate control signal GS1 and a data control signal DS1. The timing controller TCON outputs the gate control signal GS1 to the gate driver GD, and outputs the data control signal DS1 to the data driver SD. Additionally, the timing controller TCON generates a mode control signal MS using the image data RGB. The timing controller TCON may output the mode control signal MS to the data driver SD and the light source control unit LC.

The gate control signal GS1 is used to drive the gate driver GD, and the data control signal DS1 is used to drive the data driver SD.

The gate driver GD generates a gate signal using the gate control signal GS1, and outputs the gate signal to the gate lines GL1 to GLn. The gate control signal GS1 may include a scanning start signal to start scanning, at least one clock signal for controlling an output period of a gate-on voltage, and an output gate enable signal for limiting a duration time of the gate-on voltage.

The data driver SD generates a gradation voltage according to the converted image data DATA using the data control signal DS1, and outputs the generated gradation voltage as a data voltage to the data lines DL1 to DLm. The data voltage may include a positive data voltage having a positive value with respect to a common voltage and a negative data voltage having a negative value with respect to the common voltage.

The data control signal DS1 may include a horizontal start signal for indicating a start of transmission of the converted image data DATA to the data driver SD, a load signal for instructing application of the data voltage to the data lines DL1 to DLm, and a reversal signal for reversing a polarity of the data voltage with respect to the common voltage.

The mode control signal MS may be a signal for controlling the data driver SD and the light source control unit LC. The mode control signal MS may select a driving mode of source driving circuits (e.g., SC1 to SC12 of FIG. 3) in the data driver SD. Furthermore, the mode control signal MS may control states of a plurality of light source parts (e.g., LM1 to LM12 of FIG. 3) corresponding to the source driving circuits (e.g., SC1 to SC12 of FIG. 3).

Although FIG. 2 exemplarily illustrates that the mode control signal MS is output to both the light source control unit LC and the data driver SD, the inventive concept is not limited thereto. For example, the light source control unit LC may receive a separate control signal synchronized with the mode control signal MS.

The light source control unit LC may receive an input voltage Vin and a dimming signal PWM from the outside (e.g., from a host), and may receive the mode control signal MS from the timing controller TCON. The light source control unit LC may output, to the light source unit LU, an on-off control signal LS1 for turning on/off of the light source unit LU in response to the mode control signal MS.

Figure 3:
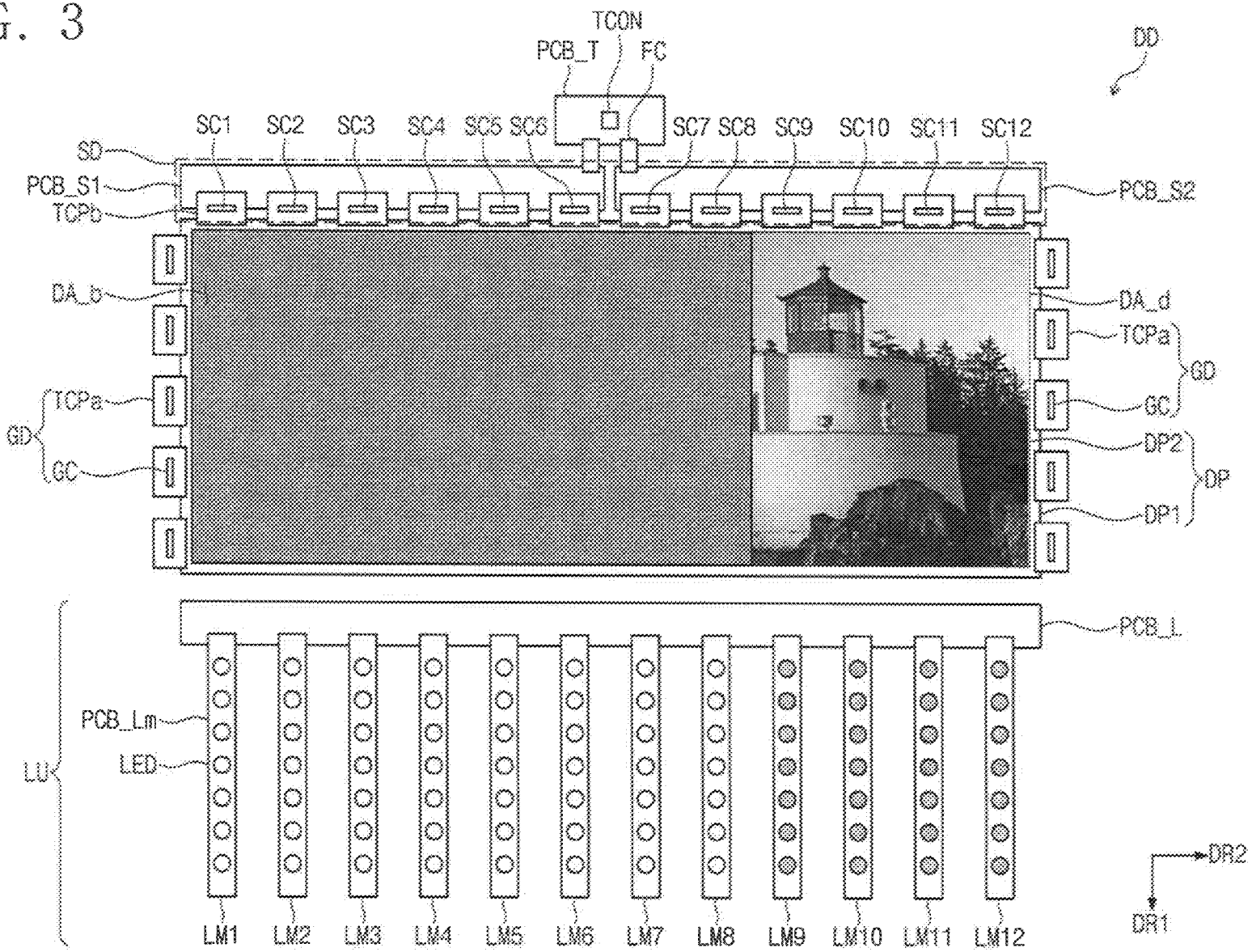
FIG. 3 is a planar view illustrating a display panel and a light source unit according to an exemplary embodiment of the inventive concept.

FIG. 3 is a planar view illustrating a display panel and a light source unit according to an exemplary embodiment of the inventive concept.

Referring to FIGS. 1 and 3, in the display region DA, a region on which a black image is displayed may be a first display region DA_b, and a remaining region may be a second display region DA_d. In other words, the first display region DA_b and the second display region DA_d are not fixed. For example, a location and an area of the first display region DA_b may change according to an image displayed on the display region DA, or the first display region DA_b may not be defined according to an image displayed on the display region DA.

In the present exemplary embodiment, the display panel DP is assumed to be a liquid crystal display panel. However, the display panel DP is not limited thereto.

The display panel DP may include a first substrate DP1, a second substrate DP2 facing the first substrate DP1, and a liquid crystal layer disposed between the first substrate DP1 and the second substrate DP2. The liquid crystal layer may include a plurality of liquid crystal molecules whose arrangement state is changed according to an electric field formed between the first substrate DP1 and the second substrate DP2. A pair of polarizing plates may be arranged on and under the display panel DP.

The gate driver GD may include a tape carrier package TCPa and gate driving circuits GC. The gate driving circuits GC may be mounted on the tape carrier package TCPa in the form of a gate driving chip.

Although FIG. 3 illustrates that five gate driving circuits GC are provided on a first side of the display panel DP and five gate driving circuits GC are provided on a second side of the display panel DP, the inventive concept is not limited thereto. For example, the gate driving circuits GC may be provided on only one side of the display panel DP, and are not provided on another side. Furthermore, the number of the gate driving circuits GC may be increased or decreased according to a size of the display panel DP or a specification of the gate driving circuits GC.

FIG. 3 exemplarily illustrates that the gate driving circuits GC are mounted on the tape carrier package TCPa, but the gate driving circuits GC may be mounted on the first substrate DP1 through a chip-on-glass process. Alternatively, in an exemplary embodiment of the inventive concept, the gate driving circuits GC may be formed at one side of the first substrate DP1 through a thin film process for forming the display panel DP. Accordingly, the gate driving circuits GC may be embedded in the display panel DP.

The data driver SD may include a tape carrier package TCPb, first to twelfth source driving circuits SC1 to SC12, and first and second printed circuits boards PCB_S1 and PCB_S2. Each of the source driving circuits SC1 to SC12 may be mounted on the tape carrier package TCPb in the form of a data driving chip. The source driving circuits SC1 to SC12 may output the data voltage to the data lines DL1 to DLm of the display panel DP.

Although 12 source driving circuits SC1 to SC12 are exemplarily illustrated, the inventive concept is not limited thereto. The number of the source driving circuits SC may be increased or decreased according to the size of the display panel DP or a specification of the source driving circuits SC. Furthermore, FIG. 3 exemplarily illustrates that six tape carrier packages TCPb are connected to the first printed circuit board PCB_S1, and six tape carrier packages TCPb are connected to the second printed circuit board PCB_S2, but the inventive concept is not limited thereto. For example, in an exemplary embodiment of the inventive concept, 12 tape carrier packages TCPb may be connected to a single printed circuit board.

In addition, the timing controller TCON is illustrated as being mounted on a separate printed circuit board PCB_T and connected to the first and second printed circuit boards PCB_S1 and PCB_S2 via a separate connecting member FC, but the inventive concept is not limited thereto. For example, the timing controller TCON may be mounted on the first printed circuit board PCB_S1 or the second printed circuit board PCB_S2 with the tape carrier package TCPb attached to the timing controller TCON. In this case, the printed circuit board PCB_T of FIG. 3 may be omitted.

The light source unit LU may include 12 light source parts LM1 to LM12 and a printed circuit board PCB_L. The printed circuit board PCB_L may be electrically connected to the printed circuit board PCB_T on which the timing controller TCON is mounted, and may receive the mode control signal MS.

The first to twelfth source driving circuits SC1 to SC12 may be arranged along the second direction DR2, and the first to twelfth light source parts LM1 to LM12 may also be arranged along the second direction DR2. Referring to FIG. 3, the first light source part LM1 may be driven in synchronization with the first source driving circuit SC1, and the second light source part LM2 may be driven in synchronization with the second source driving circuit SC2. Likewise, the third to twelfth light source parts LM3 to LM12 may be driven in synchronization with the third to twelfth source driving circuits SC3 to SC12, respectively.

Referring to FIG. 3, the first to eighth source driving circuits SC1 to SC8 may apply the data voltage to data lines arranged on the first display region DA_b on which a black image is displayed, and the ninth to twelfth source driving circuits SC9 to SC12 may apply the data voltage to the second display region DA_d on which a predetermined image is displayed. In this case, the first to eighth source driving circuits SC1 to SC8 may operate in a first mode which is a power saving mode, and the ninth to twelfth source driving circuits SC9 to SC12 may operate in a second mode which is a normal driving mode. Relevant detailed description will be provided below with reference to FIGS. 4 and 5.

When the first to eighth source driving circuits SC1 to SC8 operate in the first mode which is the power saving mode, the first to eight light source parts LM1 to LM8, which operate in synchronization with the first to eighth source driving circuits SC1 to SC8, may be turned off. When the ninth to twelfth source driving circuits SC9 to SC12 operate in the second mode which is the normal driving mode, the ninth to twelfth light source parts LM9 to LM12, which operate in synchronization with the ninth to twelfth source driving circuits SC9 to SC12, may be turned on.

According to the present exemplary embodiment, the first to twelfth light source parts LM1 to LM12 operate in synchronization with the first to twelfth source driving circuits SC1 to SC12. Therefore, the light source parts may be controlled with ease without using a complex algorithm or a complex circuit. Furthermore, since the first to eighth light source parts LM1 to LM8, corresponding to the first display region DA_b on which a black image is displayed, are turned off, power consumption may be reduced and a contrast ratio may be increased, and thus, display quality may be increased.

As some of the light source parts are turned off, a luminance of the other light source parts that are turned on may be adjusted. The luminance of the light source parts that are turned on may be adjusted by adjusting a duty ratio of the dimming signal PWM described above with reference to FIG. 2. For example, referring to FIG. 3, the first to eighth light source parts LM1 to LM8 are turned off, and the ninth to twelfth light source parts LM9 to LM12 are turned on. In this case, the luminance of the ninth to twelfth light source parts LM9 to LM12 may be increased. For example, the luminance of light emitted from the ninth to twelfth light source parts LM9 to LM12 when only the ninth to twelfth light source parts LM9 to LM12 are turned on may be higher than the luminance of light emitted from the ninth to twelfth light source parts LM9 to LM12 when all of the first to twelfth light source parts LM1 to LM12 are turned on.

Alternatively, in an exemplary embodiment of the inventive concept, only the luminance of the ninth light source part LM9, which is adjacent to the first to eighth light source parts LM1 to LM8 that are turned off, may be adjusted.

Each of the first to twelfth light source parts LM1 to LM12 may include a printed circuit board PCB_Lm and a plurality of light sources LED. The light sources LED may be mounted on the printed circuit board PCB_Lm, and may receive a driving voltage from the printed circuit board PCB_Lm. The light sources LED may be arranged in the first direction DR1.

Figure 4:
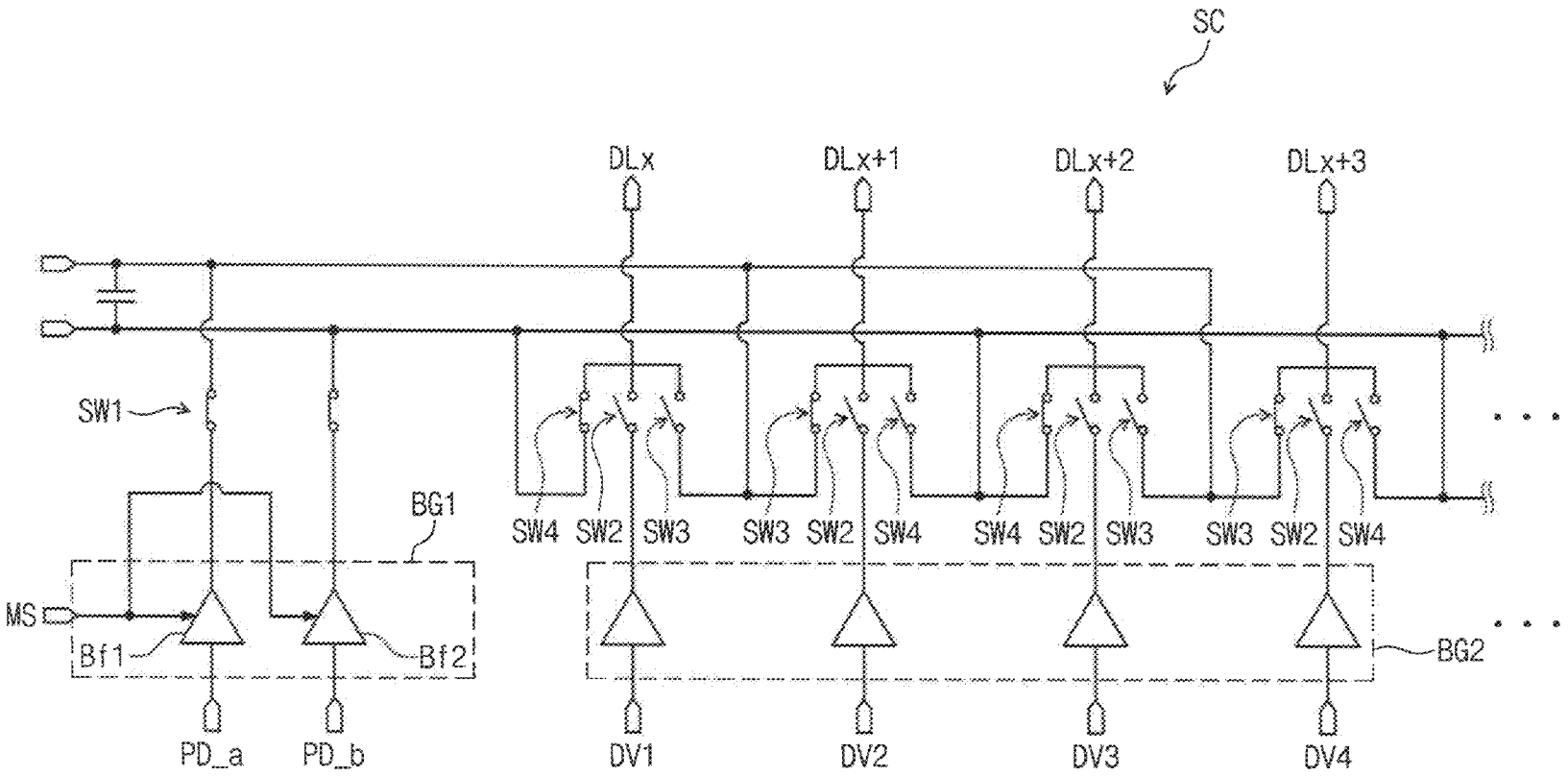
FIG. 4 is a circuit diagram illustrating a source driving circuit operating in a first mode according to an exemplary embodiment of the inventive concept.
Figure 5:
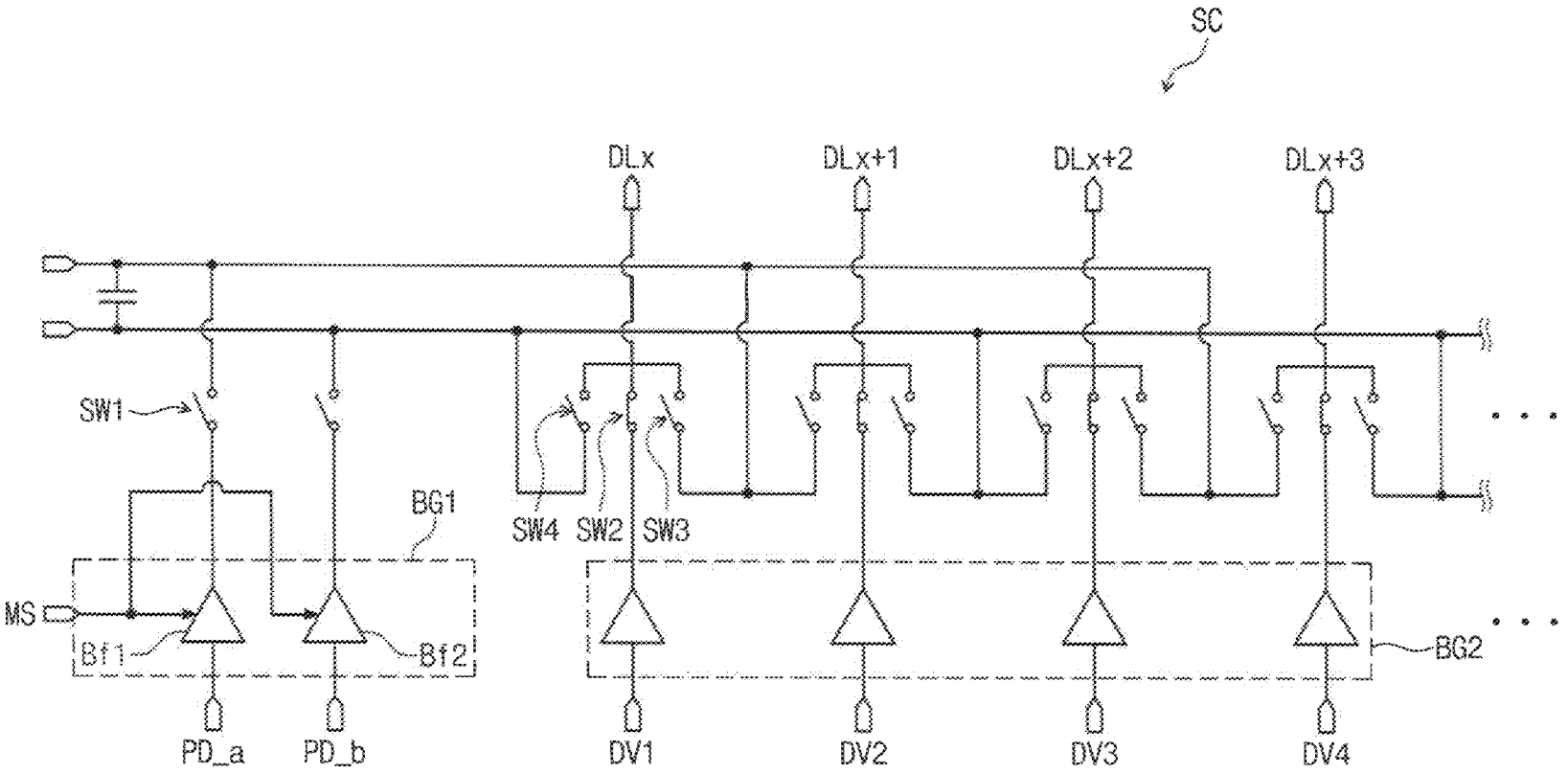
FIG. 5 is a circuit diagram illustrating the source driving circuit operating in a second mode according to an exemplary embodiment of the inventive concept.

FIG. 4 is a circuit diagram illustrating a source driving circuit operating in a first mode, and FIG. 5 is a circuit diagram illustrating the source driving circuit operating in a second mode, according to an exemplary embodiment of the inventive concept.

Referring to FIGS. 4 and 5, the source driving circuit SC (e.g., one of the first to twelfth source driving circuits SC1 to SC12 of FIG. 3) may include a first buffer group BG1 and a second buffer group BG2. When the source driving circuit SC operates in the first mode, the first buffer group BG1 may be enabled, and the second buffer group BG2 may be disabled. When the source driving circuit SC operates in the second mode, the first buffer group BG1 may be disabled, and the second buffer group BG2 may be enabled. The number of buffers included in the first buffer group BG1 may be smaller than the number of buffers included in the second buffer group BG2.

The first buffer group BG1 may include two buffers. However, this is merely an example, and the inventive concept is not limited thereto. For example, the first buffer group BG1 may include one buffer or more than two buffers.

A first buffer Bf1 of the first buffer group BG1 may receive a positive black data voltage PD_a, and a second buffer Bf2 of the first buffer group BG1 may receive a negative black data voltage PD_b.

The second buffer group BG2 may include buffers, the number of which corresponds to the number of data lines connected to the source driving circuit SC. For example, if one source driving circuit SC is connected to 966 data lines, the second buffer group BG2 may include 966 buffers. However, this is merely an example, and the inventive concept is not limited thereto.

FIG. 4 partially illustrates the source driving circuit SC operating in the first mode. Each of the first to eighth source driving circuits SC1 to SC8, described above with reference to FIG. 3, may operate in substantially the same manner as described with reference to FIG. 4.

When the mode control signal MS is input, the first buffer group BG1 may be enabled, and the second buffer group BG2 may be disabled. For example, a first switch SW1 connected to the first buffer group BG1 may be turned on, and a second switch SW2 connected to the second buffer group BG2 may be turned off.

Each of data lines DLx, DLx+1, DLx+2, and DLx+3 may be electrically connected to the first buffer Bf1 via a third switch SW3, or may be electrically connected to the second buffer Bf2 via a fourth switch SW4. Therefore, the data lines DLx, DLx+1, DLx+2, and DLx+3 connected to the source driving circuit SC may receive the data voltage via the first buffer group BG1.

FIG. 4 exemplarily illustrates a case where black data voltages of different polarities are output for each data line. The fourth switch SW4 connected to the xth data line DLx may be turned on, and the third switch SW3 connected thereto may be turned off. In this case, the negative black data voltage PD_b may be output to the xth data line DLx via the second buffer Bf2. Furthermore, the third switch SW3 connected to the (x+1)th data line DLx+1 may be turned on, and the fourth switch SW4 connected thereto may be turned off. In this case, the positive black data voltage PD_a may be output to the (x+1)th data line DLx+1 via the first buffer Bf1. However, this is merely an example, and the inventive concept is not limited thereto. For example, when performing reversal driving for each frame, each of the data lines DLx, DLx+1, DLx+2, and DLx+3 may be electrically connected to the first buffer Bf1 via the third switch SW3 at a first frame, and then, at a next or second frame, each of the data lines DLx, DLx+1, DLx+2, and DLx+3 may be electrically connected to the second buffer Bf2 via the fourth switch SW4.

FIG. 5 partially illustrates the source driving circuit SC operating in the second mode. The ninth to twelfth source driving circuits SC9 to SC12, described above with reference to FIG. 3, may operate in substantially the same manner as described with reference to FIG. 5.

When the source driving circuit SC operates in the second mode, the first buffer group BG1 may be disabled, and the second buffer group BG2 may be enabled. For example, the first switch SW1 connected to the first buffer group BG1 may be turned off, and the second switch SW2 connected to the second buffer group BG2 may be turned on. In this case, the third switch SW3 which electrically connects the first buffer Bf1 to a data line and the fourth switch SW4 which electrically connects the second buffer Bf2 to a data line may both be turned off.

Each of the data lines DLx, DLx+1, DLx+2, and DLx+3 may be connected to the buffers in the second buffer group BG2 via the second switch SW2 on a one-to-one basis. Therefore, the data lines DLx, DLx+1, DLx+2, and DLx+3 connected to the source driving circuit SC may receive data voltages DV1 to DV4 via the second buffer group BG2.

Figure 6:
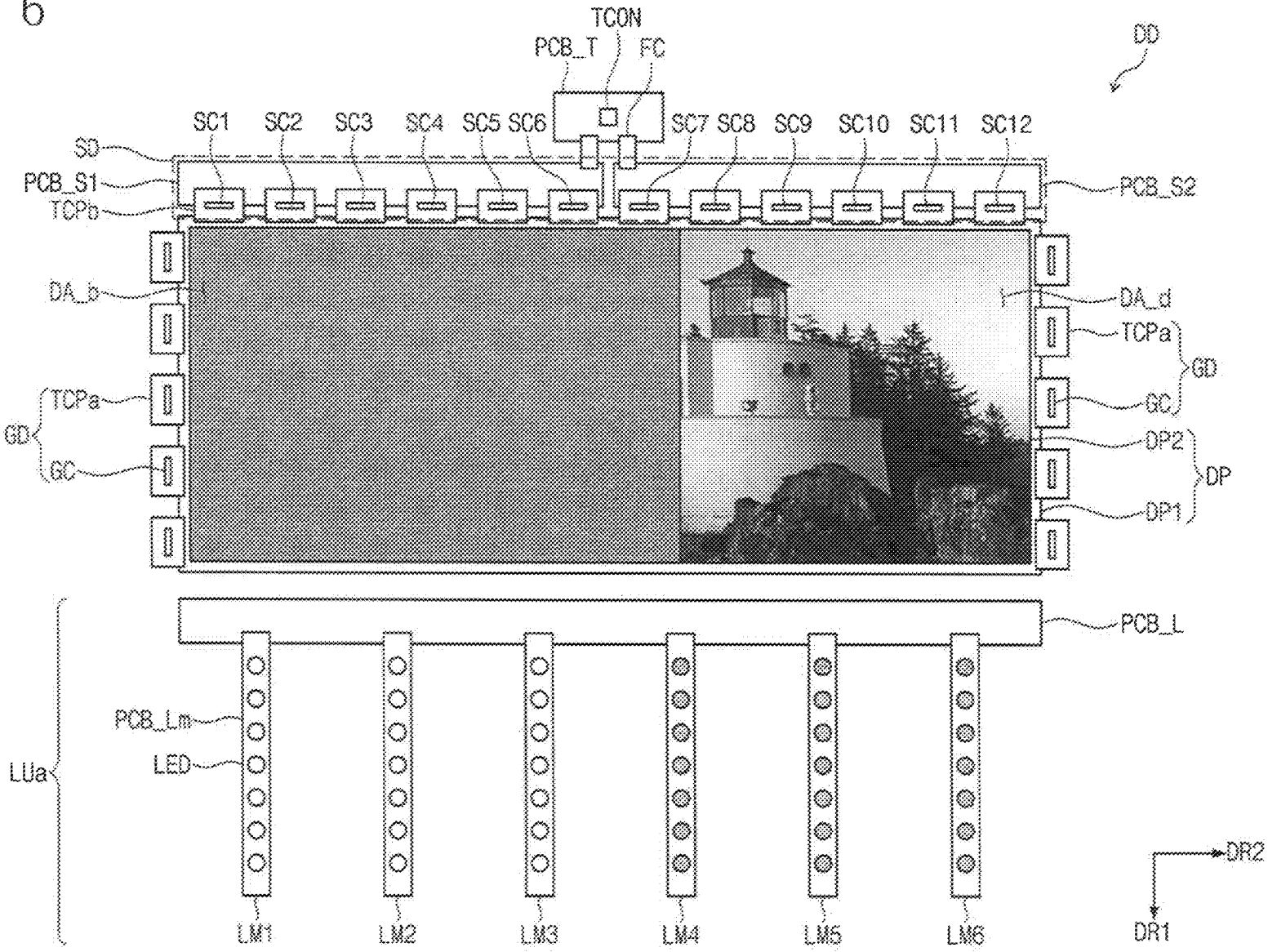
FIG. 6 is a planar view illustrating a display panel and a light source unit according to an exemplary embodiment of the inventive concept.

FIG. 6 is a planar view illustrating a display panel and a light source unit according to an exemplary embodiment of the inventive concept.

Referring to FIG. 6, a light source unit LUa may include the first to sixth light source parts LM1 to LM6 and the printed circuit board PCB_L. The printed circuit board PCB_L may be connected to the printed circuit board PCB_T on which the timing controller TCON is mounted, and may receive the mode control signal MS.

The first to twelfth source driving circuits SC1 to SC12 may be arranged along the second direction DR2, and the first to sixth light source parts LM1 to LM6 may also be arranged along the second direction DR2.

Each of the first to sixth light source parts LM1 to LM6 may include the printed circuit board PCB_Lm and the plurality of light sources LED. The light sources LED may be mounted on the printed circuit board PCB_Lm, and may receive the driving voltage from the printed circuit board PCB_Lm. The light sources LED may be arranged in the first direction DR1.

In the present exemplary embodiment, one light source part may operate in synchronization with two source driving circuits. However, this is merely an example, and the inventive concept is not limited thereto. In an exemplary embodiment of the inventive concept, one light source part may operate in synchronization with three or more source driving circuits. In an exemplary embodiment of the inventive concept, one light source part may operate in synchronization with one source driving circuit, and another light source part may operate in synchronization with a plurality of source driving circuits.

For example, referring to FIG. 6, the first light source part LM1 may operate in synchronization with the first source driving circuit SC1 and the second source driving circuit SC2, and the second light source part LM2 may operate in synchronization with the third source driving circuit SC3 and the fourth source driving circuit SC4. Each of the third to sixth light source parts LM3 to LM6 may also operate in synchronization with two source driving circuits.

Each of the first to sixth light source parts LM1 to LM6 may be turned off when the two source driving circuits synchronized therewith both operate in the first mode. Referring to FIG. 6, the first to seventh source driving circuits SC1 to SC7 may operate in the first mode, and the eighth to twelfth source driving circuits SC8 to SC12 may operate in the second mode. In this case, the first to third light source parts LM1 to LM3 synchronized with the first to sixth source driving circuits SC1 to SC6 may be turned off, and the fifth and sixth light source parts LM5 and LM6 synchronized with the ninth to twelfth source driving circuits SC9 to SC12 may be turned on. Here, since the seventh source driving circuit SC7 operates in the first mode and the eighth source driving circuit SC8 operates in the second mode, the fourth light source part LM4 synchronized with the seventh and eighth source driving circuits SC7 and SC8 may also be turned on.

Figure 7:
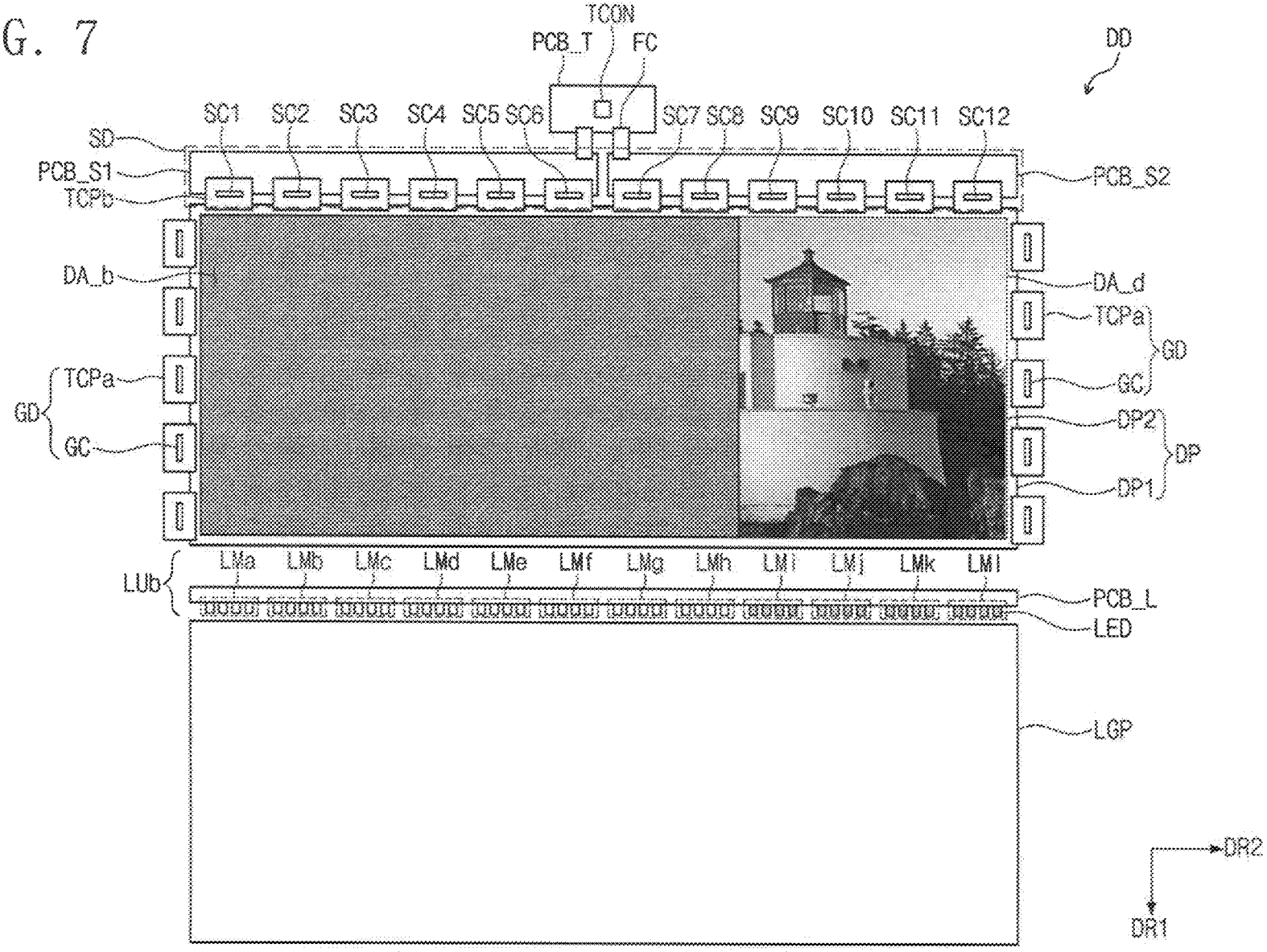
FIG. 7 is a planar view illustrating a display panel and a light source unit according to an exemplary embodiment of the inventive concept.

FIG. 7 is a planar view illustrating a display panel and a light source unit according to an exemplary embodiment of the inventive concept.

The light source units LU and LUa described above with reference to FIGS. 3 and 6, respectively, are arranged under the display panel DP, and thus, light may be directly irradiated to the display region DA of the display panel DP. However, referring to FIG. 7, a light source unit LUb may be disposed to face one side of a light guide part LGP, which may be disposed under the display panel DP. The light source unit LUb may provide light to the one side of the light guide part LGP, and the light guide part LGP may guide the light provided from the light source unit LUb, so as to provide the light to the display panel DP.

The light source unit LUb may include first to twelfth light source parts LMa to LMl and the printed circuit board PCB_L. Each of the first to twelfth light source parts LMa to LMl may include the plurality of light sources LED. The light sources LED may be mounted on the printed circuit board PCB_L, and may receive the driving voltage from the printed circuit board PCB_L.

The first to twelfth light source parts LMa to LMl may correspond to the first to twelfth source driving circuits SC1 to SC12 on a one-to-one basis to operate in synchronization therewith. Therefore, referring to FIG. 7, when the first to eighth source driving circuits SC1 to SC8 operate in the first mode and the ninth to twelfth source driving circuits SC9 to SC12 operate in the second mode, the first to eighth light source parts LMa to LMh may be turned off and the ninth to twelfth light source parts LMi to LMl may be turned on.

According to the present exemplary embodiment, the first to twelfth light source parts LMa to LMl operate in synchronization with the first to twelfth source driving circuits SC1 to SC12, respectively. Therefore, the light source parts may be controlled with ease without using a complex algorithm or a complex circuit. Furthermore, since the first to eighth light source parts LMa to LMh corresponding to the first display region DA_b on which a black image is displayed are turned off, power consumption may be reduced and the contrast ratio may be increased, and thus, the display quality may be increased.

While the inventive concept has been shown and described with reference to exemplary embodiments thereof, it will be apparent to those of ordinary skill in the art that various modifications in form and details may be made thereto without materially departing from the spirit and scope of the inventive concept as defined by the following claims.

What is claimed is:

1. A display device comprising:

a display panel comprising a plurality of data lines;

a timing controller configured to receive a control signal and image data, and output a data control signal, converted image data, and a mode selection signal;

a data driver configured to receive the data control signal, the converted image data, and the mode selection signal from the timing controller, output a data voltage to the plurality of data lines, and operate in a first mode which is a power saving mode or a second mode which is a normal driving mode in response to the mode selection signal;

a light source unit configured to operate in association with the data driver; and a light source control unit configured to receive the mode selection signal and control the light source unit in response to the mode selection signal, wherein the data driver comprises a first source driving circuit comprising a first buffer group and a second buffer group, wherein the first source driving circuit is configured to output a black data voltage via the first buffer group when operating in the first mode, and to output the data voltage via the second buffer group when operating in the second mode, wherein the light source unit comprises a first light source part configured to operate in association with the first source driving circuit, and wherein the first light source part is turned off when the first source driving circuit operates in the first mode in response to the mode selection signal, and is turned on when the first source driving circuit operates in the second mode in response to the mode selection signal.

2. The display device of claim 1, wherein the first light source part provides light to a region of the display panel that receives the data voltage from the first source driving circuit.

3. The display device of claim 1, wherein the first light source part is turned on or turned off in response to the mode selection signal.

4. The display device of claim 1, wherein the data driver further comprises a second source driving circuit disposed adjacent to the first source driving circuit, and the light source unit further comprises a second light source part configured to operate in association with the second source driving circuit.

5. The display device of claim 4, wherein a luminance of light provided from the second light source part when both the first light source part and the second light source part are turned on is lower than the luminance of the light provided from the second light source part when the first light source part is turned off and the second light source part is turned on.

6. The display device of claim 4, wherein the light source unit further comprises a third light source part disposed between the first light source part and the second light source part, wherein the third light source part is configured to operate in association with the first source driving circuit and the second source driving circuit, and wherein the third light source part is turned off when both the first source driving circuit and the second source driving circuit operate in the first mode, and is turned on when at least one of the first source driving circuit or the second source driving circuit operates in the second mode.

7. The display device of claim 4, wherein each of the plurality of data lines extends along a. first direction, and the second light source part is spaced apart from the first light source part in a second direction intersecting with the first direction.

8. The display device of claim 7, wherein each of the first light source part and the second light source part comprises a plurality of light sources, and wherein the plurality of light sources is arranged along the first direction.

9. The display device of claim 7, further comprising:

a light guide part disposed under the display panel, wherein the first light source part and the second light source part are arranged to face one side of the light guide part.

10. The display device of claim 1, wherein a number of buffers included in the first buffer group is smaller than a number of buffers included in the second buffer group.

11. A display device comprising:

a display panel configured to display an image and comprising a plurality of data lines;

a data driver configured to supply a data voltage to the plurality of data lines and comprising a plurality of source driving circuits; and a light source unit configured to provide light to the display panel and comprising a plurality of light source parts configured to operate in synchronization with the plurality of source driving circuits, wherein each of the plurality of source driving circuits comprises a first buffer group and a second buffer group, wherein, when a first portion of the plurality of source driving circuits operates in a first mode and a second portion of the plurality of source driving circuits operates in a second mode, the first portion of the plurality of source driving circuits outputs the data voltage via the first buffer group to display a black image, a first portion of the plurality of light source parts synchronized with the first portion of the plurality of source driving circuits is turned off, the second portion of the plurality of source driving circuits outputs the data voltage via the second buffer group, and a second portion of the plurality of light source parts synchronized with the second portion of the plurality of source driving circuits is turned on, wherein each of the plurality of light source parts is synchronized with two or more corresponding source driving circuits amongst the plurality of source driving circuits, and wherein, for each of the plurality of light source parts, that light source part is turned off when all of the corresponding source driving circuits synchronized therewith operate in the first mode.

12. The display device of claim 11, wherein, when a first source driving circuit amongst the plurality of source driving circuits operates in the first mode, a first light source part amongst the plurality of light source parts, which is synchronized with the first source driving circuit, is turned off.

13. The display device of claim 12, wherein a luminance of a second light source part amongst the plurality of light source parts, which is adjacent to the first light source part, is higher when the first light source part is turned off than when the first light source part is turned on.

14. The display device of claim 11, wherein a luminance of turned-on light source parts is higher when at least one hut not all of the plurality of light source parts is turned on than when all the plurality of light source parts are turned on.

15. The display device of claim 11, wherein each of the plurality of data lines extends along a first direction, and the plurality of light source parts is arranged along a second direction intersecting with the first direction.

16. The display device of claim 15, wherein each of the plurality of light source parts comprises a plurality of light sources, and wherein the plurality of light sources is arranged along the first direction.

17. The display device of claim 15, further comprising:

a light guide part disposed under the display panel, wherein the plurality of light source parts is arranged to face one side of the light guide part.

18. The display device of claim 11, wherein a number of buffers included in the first buffer group is smaller than a number of buffers included in the second buffer group.

19. A display device comprising:

a display panel comprising a plurality of data lines;

a data driver comprising a source driving circuit; and a light source unit comprising a light source part configured to operate in synchronization with the source driving circuit, wherein the source driving circuit comprises:

a first buffer group connected to the plurality of data lines via a. first switch and comprising a first buffer and a second buffer; and a second buffer group connected to the plurality of data fines via a second switch, wherein in a first mode of the source driving circuit, the light source part is turned off, the first switch is turned on, the second switch is turned off, and each of the plurality of data lines is electrically connected to either the first buffer or the second buffer, wherein in a second mode of the source driving circuit, the light source part is turned on, the first switch is turned off, and the second switch is turned on, and wherein the first buffer is configured to receive only a first black data voltage and the second buffer is configured to receive only a second black data voltage.

* * * * *